US005664989A

United States Patent [19]

Nakata et al.

[11] Patent Number: 5,664,989

[45] Date of Patent: Sep. 9, 1997

[54] POLISHING PAD, POLISHING APPARATUS AND POLISHING METHOD

[75] Inventors: Rempei Nakata, Kamakura; Hisashi Kaneko, Fujisawa; Nobuo Hayasaka, Yokosuka; Takeshi Nishioka, Yokohama; Yoshikuni Tateyama, Hiratsuka; Yutaka Nakano, Yokkaichi; Yasutaka Sasaki, Natori, all of Japan

[73] Assignee: Kabushiki Kaisha Toshiba, Kawasaki, Japan

[21] Appl. No.: 683,265

[22] Filed: Jul. 18, 1996

[30] Foreign Application Priority Data

Jul. 21, 1995 [JP] Japan ..... 7-185862
Jan. 5, 1996 [JP] Japan ..... 8-000332

[51] Int. Cl.[6] ..... B24B 1/00

[52] U.S. Cl. ..... 451/41; 451/285; 451/287; 451/288; 451/533; 451/526

[58] Field of Search ..... 451/36, 37, 41, 451/285, 287, 288, 495, 527, 526, 532, 530, 539, 533

[56] References Cited

U.S. PATENT DOCUMENTS 3,504,457 4/1970 Jacobsen et al. .
5,212,910 5/1993 Breivogel et al. ..... 451/287
5,257,478 11/1993 Hyde et al. .

FOREIGN PATENT DOCUMENTS 61-230857 10/1986 Japan .
5-505769 8/1993 Japan .
5-285825 11/1993 Japan .
7-164307 6/1995 Japan .

OTHER PUBLICATIONS

H. Jeong et al. "New Polishing Techniques for Planarization of VLSI Device Wafers," First International ABTEC Cont. Nov. 1993; pp. 80–85.

*Primary Examiner*—Eileen Morgan
*Attorney, Agent, or Firm*—Oblon, Spivak, McClelland, Maier & Neustadt, P.C.

[57] ABSTRACT

A polishing pad comprises at least a first layer having a first main surface serving to polish a substrate to be polished and a second main surface, and a second layer positioned to face the second main surface of the first layer and having fine bags arranged therein, fluid being hermetically sealed in the fine bag.

30 Claims, 11 Drawing Sheets

POLISHING PAD, POLISHING APPARATUS AND POLISHING METHOD

BACKGROUND OF THE INVENTION

1. Field of the Invention

The present invention relates to a polishing technology employed in the manufacture of a semiconductor device, particularly, to a polishing pad used for a chemical-mechanical polishing (CMP) as well as to a polishing apparatus and a polishing method using the particular polishing pad.

2. Description of the Related Art

In recent years, vigorous research has been made in an attempt to develop various fine processing technologies to meet tendencies toward a higher degree of integration and higher performance of LSI. The CMP technology is one of the objects of research being made to meet the severe requirement for miniaturization, and is absolutely required in the process of a multi-wiring formation including the steps of flattening the interlayer insulating film, forming a metal plug, and forming a buried wiring layer, and in the process of separating the buried elements.

One of the most serious problems inherent in the CMP process is nonuniformity of the polishing rate over the entire surface of an object to be polished, e.g., a semiconductor wafer. To be more specific, a nonuniform pressure distribution over the entire surface of a wafer causes a nonuniform polishing rate of the wafer, with the result that some surface region of the wafer is polished excessively while the polishing in another surface region is made insufficient. The nonuniformity of polishing is a serious problem which adversely affects seriously the yield and reliability of semiconductor elements, when it comes to, particularly, a large wafer having a diameter of, for example, 8 inches. It should be noted that, in order to employ the CMP technology in the manufacturing process of a semiconductor device in the generation of 0.25 μm such as 256 DRAM, it is necessary to control the film thickness on the order of 0.01 μm, making it very important to develop technology which permits further improving the uniformity of polishing rate over the entire surface of the wafer.

FIG. 1 attached hereto is intended to show what the polishing nonuniformity is in the case where CMP is employed in the step of flattening an interlayer insulating film. As shown in FIG. 1A, a lower wiring layer 211 is formed in a thickness of 0.4 μm or less on a wafer, followed by depositing an interlayer insulating film 212 in a thickness of 1 μm to cover the lower wiring layer 211. What should be noted is that the presence of the lower wiring layer 211 causes the interlayer insulating film 212 to have stepped portions. In the next step, the projecting portions of the interlayer insulating film 212 are removed by CMP to flatten the film 212 as shown in FIG. 1B. Then, contact holes are selectively formed in the film 212 to expose the upper surfaces of the lower wiring layer 211, followed by forming an upper wiring layer 214 connected to the lower wiring layer 211 via contacts 213, as shown in FIG. 1C.

Suppose the chemical-mechanical polishing (CMP) is performed in the process described above with an average polishing amount of 0.5 μm and a uniformity in the polishing rate of ±10% over the entire surface of the wafer. In this case, the thickness of the interlayer insulating film 212 above the lower wiring layer 211, which was 1 μm before the CMP step, is rendered nonuniform within a range of between 0.45 μm and 0.55 μm (Δ0.1 μm) after the step of CMP.

The nonuniformity in the thickness of the interlayer insulating film after the CMP step leads directly to a nonuniformity in the over-etching time in RIE in the step of forming contact holes and to a nonuniformity in the resistance values of the contacts, which is derived from a nonuniformity in the diameters of the contact holes. It follows that the nonuniformity in the thickness of the interlayer insulating film after the CMP step leads to a low yield in the manufacture of the semiconductor element. On the other hand, where the CMP technology is employed in the formation of a buried wiring layer, the nonuniform polishing rate over the entire surface of a wafer leads to nonuniform resistance values of the wiring and, thus, to a low yield in the manufacture of the semiconductor device. Such being the situation, it is of high importance to improve the uniformity of the polishing rate in order to employ the CMP technology in the VLSI process.

Various polishing pads are being proposed in an attempt to improve the uniformity of the polishing rate over the entire surface of a wafer. For example, it is proposed in each of Japanese Patent Disclosure (Kokai) No. 58-45861 and Japanese Patent Disclosure No. 57-23965 that a relatively hard polishing pad is mounted on a soft elastic material so as to ensure a local flatness (or suppress dishing) and to improve the polishing uniformity over the entire surface of the wafer. In the technique disclosed in these prior art publications, however, a nonuniform pressure distribution is generated because of the mechanical properties of the soft elastic material itself such as the rigidity (or elasticity) in the horizontal or vertical direction, making it difficult to improve satisfactorily the polishing uniformity over the entire surface of the wafer. In conclusion, the conventional CMP technology fails to suppress sufficiently the nonuniformity in the polishing rate over the entire surface of a wafer, leading to a low yield and impaired reliability of the semiconductor element.

On the other hand, a polishing pad using a fluid cushion in place of the Soft elastic material is proposed in, for example, Japanese Patent Disclosure No. 5-285825 and Japanese Patent Disclosure No. 5-505769 in an attempt to further improve the polishing uniformity of the wafer. In the fluid cushion, the load distribution on the work surface is made uniform on the basis of Pascal's law so as to improve the polishing uniformity. However, the polishing pad using a fluid cushion leaves room for further improvements, as pointed out below with reference to FIG. 2.

Specifically, a fluid cushion 224 prepared by, for example, sealing a gas in a polyethylene bag is arranged between a polishing pad 223 and a polishing base body 225 in the conventional polishing apparatus, as shown in FIG. 2A. In polishing a wafer surface by using the conventional apparatus, each of a polishing head 221 supporting, for example, a semiconductor wafer 222 and the polishing base body 225 of the polishing apparatus is rotated each at 100 rpm. During the rotation, the wafer 222 is pressed against the polishing pad 223 with a load of 300 g/cm$^2$ while a polishing agent is supplied to the polishing pad 223 through a pipe 227. In the conventional polishing apparatus, however, the polishing pad 223 and the fluid cushion 224 are markedly deformed during the polishing operation, as shown in FIG. 2B. The deformation causes the polishing head to be vibrated. Also, the rotating speed of the polishing head or the polishing pad is rendered unstable. As a result, the uniformity in the polishing rate over the entire surface of the wafer fails to be improved. Also, the stability of the polishing rate tends to be lowered.

SUMMARY OF THE INVENTION

An object of the present invention is to provide a polishing pad which permits the pressure distribution to be uniform over the entire surface of, for example, a semiconductor wafer and also permits improving the uniformity in the polishing rate over the entire surface of the wafer.

Another object is to provide a polishing apparatus which permits polishing a wafer surface uniformly over the entire surface of the wafer.

Still another object is to provide a polishing method which permits polishing a wafer surface uniformly over the entire surface of the wafer.

According to a first aspect of the present invention, there is provided a polishing pad, comprising at least:

a first layer having a first main surface serving to polish a substrate to be polished and a second main surface; and a second layer positioned to face the second surface of the first layer and having fine bags arranged therein, fluid being hermetically sealed in the fine bags.

According to a second aspect of the present invention, there is provided a polishing apparatus, comprising:

means for holding or pressing a substrate to be polished;

a base body having fine bags arranged thereon; and a polishing pad interposed between the means for holding or pressing the substrate and the base body.

According to a third aspect of the present invention, there is provided a polishing method, comprising the steps of:

allowing a substrate to be held on a substrate holding section;

supplying a polishing agent onto a polishing surface positioned on fine bags arranged on a base body; and rotating the base body to permit the substrate-holding section to be pressed against the base body so as to polish a surface of the substrate to be polished.

According to a fourth aspect of the present invention, there is provided a polishing pad comprising at least:

a first layer having a first main surface serving to polish a substrate to be polished and a second main surface; and a second layer positioned to face the second surface of the first layer and having a fluid-retaining section filled with fluid, a number of reinforcing strings being arranged within the fluid-retaining section.

According to a fifth aspect of the present invention, there is provided a polishing apparatus, comprising:

means for holding or pressing a substrate to be polished;

a base body having a fluid-retaining section arranged on an upper surface thereof, a number of reinforcing strings being arranged within the fluid-retaining section; and a polishing pad interposed between the means for holding or pressing the substrate and the base body.

Further, according to a sixth aspect of the present invention, there is provided a polishing method, comprising the steps of:

allowing a substrate to be held on a substrate holding section;

supplying a polishing agent onto a polishing surface positioned on a fluid-supporting section formed on a base body, a number of reinforcing strings being arranged within the fluid-supporting section; and rotating the base body to permit the substrate-holding section to be pressed against the base body so as to polish a surface of the substrate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention; in which.

DETAILED DESCRIPTION OF THE PREFERRED EMBODIMENTS

In a polishing apparatus of the present invention, a fluid-retaining section is used in place of a soft elastic material used in the conventional apparatus for supporting a polishing pad. Since a fluid sealed in a container exerts an equal pressure in every point within the fluid, the fluid-retaining section included in the polishing apparatus of the present invention permits the polishing pad to be pressed uniformly against a polishing surface of a substrate to be polished over the entire surface of the substrate. The fluid-supporting section is formed of a fluid mat having fine bags arranged therein, each bag having fluid hermetically sealed therein. Alternatively, the fluid-retaining section is reinforced by reinforcing strings. Because of the particular construction, deformation of the fluid-retaining section can be diminished when the substrate is pressed against the polishing pad while rotating these substrate and the polishing pad. As a result, each of a polishing pad-supporting plate and a sample-supporting plate can be rotated with a high stability, leading to an improved uniformity of the polishing rate over the entire surface of the substrate and, thus, to an improved yield in the manufacture of semiconductor elements.

Let us describe some embodiments of the present invention with reference to accompanying drawings.

Embodiment 1

Figure 1A:
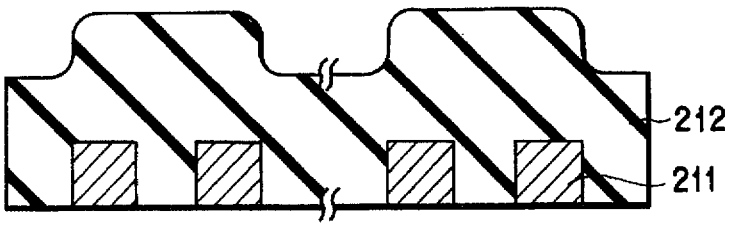
FIGS. 1A to 1C are cross sectional views collectively showing how a multi-layer wiring is formed by using a conventional polishing apparatus.
Figure 1B:
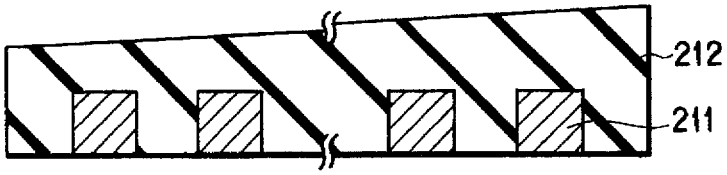
Figure 1C:
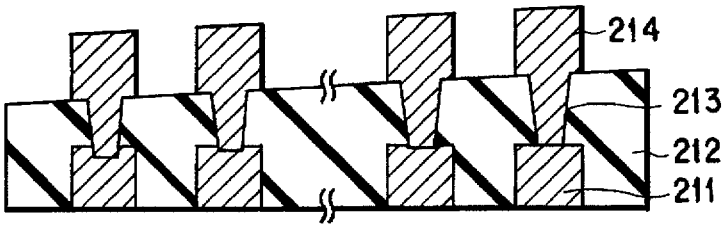
Figure 2A:
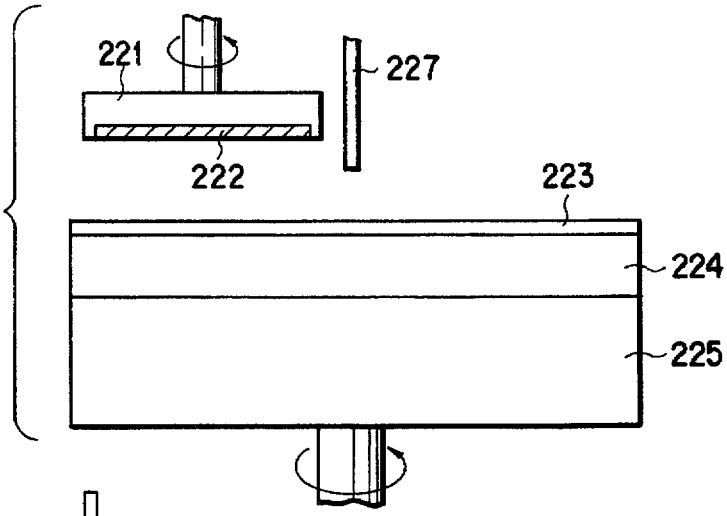
FIGS. 2A and 2B are cross sectional views collectively showing schematically the construction of a conventional polishing apparatus.
Figure 2B:
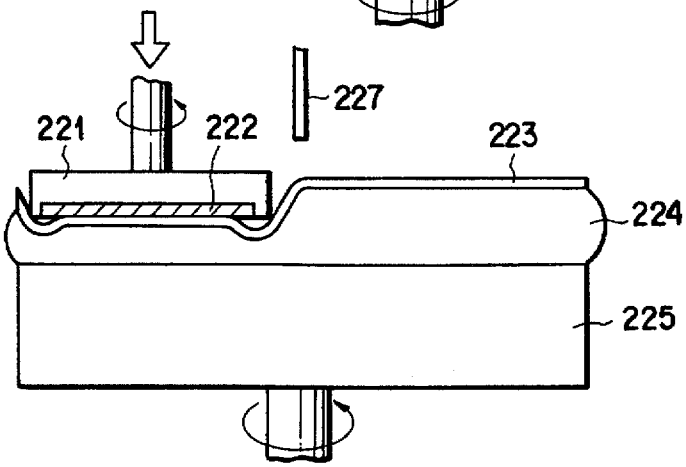
Figure 3:
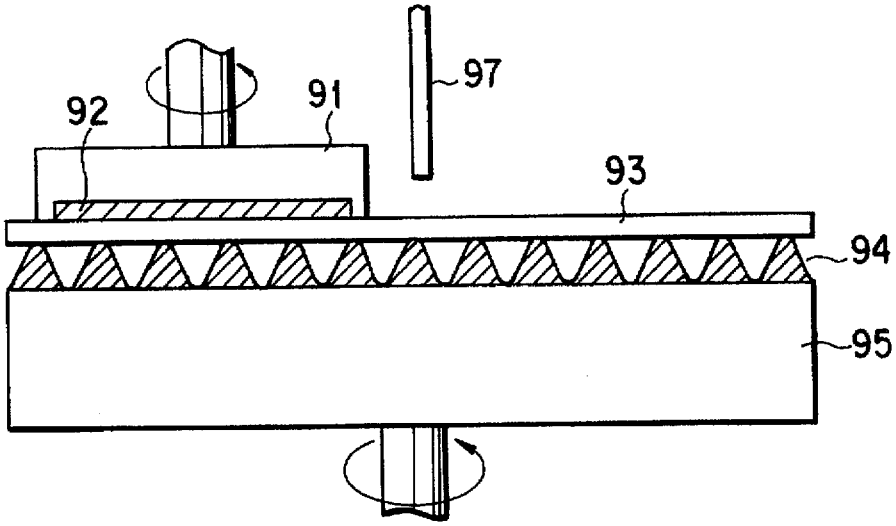
FIG. 3 is a cross sectional view schematically showing the construction of a polishing apparatus according to a first embodiment of the present invention.

FIG. 3 is a cross sectional view schematically showing the construction of a polishing apparatus according to a first embodiment of the present invention. As shown in the drawing, a substrate 92 to be processed is held by a rotatable sample holder 91 by means of a vacuum chuck such that the surface to be polished of the substrate 92 faces downward. Also, the polishing surface of the substrate is pushed against a polishing pad fixed to a rotatable SUS base body 95. As seen from the drawing, the polishing pad includes a surface sheet 93 which is brought into contact with the polishing surface of the substrate 92 and a large number of fine bags (air-cells) fixed to the SUS base body 95 and each having air sealed therein.

Figure 4:
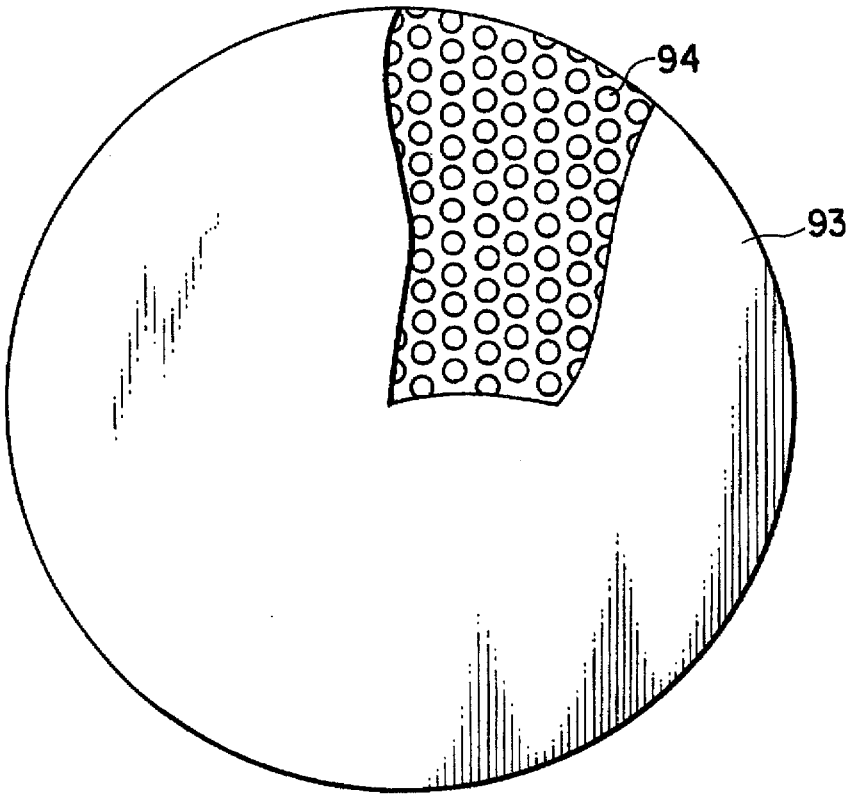
FIG. 4 is a top view showing an air-cell mat included in the polishing apparatus shown in FIG. 3.

FIG. 4 shows the air-cells as seen from above. In this embodiment, the polishing pad consists of a foamed polyurethane sheet 93 having a thickness of 1.3 mm and a mat having air-cells 94 each having a diameter of 31 mm, a height of 13 mm and a volume of 8 $cm^3$, which are sealed with air of the atmospheric pressure, regularly arranged thereon. These air-cells are arranged such that a cell ratio, i.e., percentage of air-cell area based on the entire surface of the polishing pad, is 70%.

A sample covered with a silicon oxide film having a stepped portion was polished by using the polishing apparatus described above so as to evaluate the uniformity of the polishing rate over the entire surface of the sample. The polishing agent used was prepared by dispersing 1% by weight of cerium oxide in water. The nonuniformity of the polishing rate was found to be as low as ±3% or less in the case of using the polishing pad in this embodiment in contrast to ±10% in the case of using a popular polishing unit (IC-100/SUBA-400: manufactured by Rodehl-Nitta).

Embodiment 2

Figure 5:
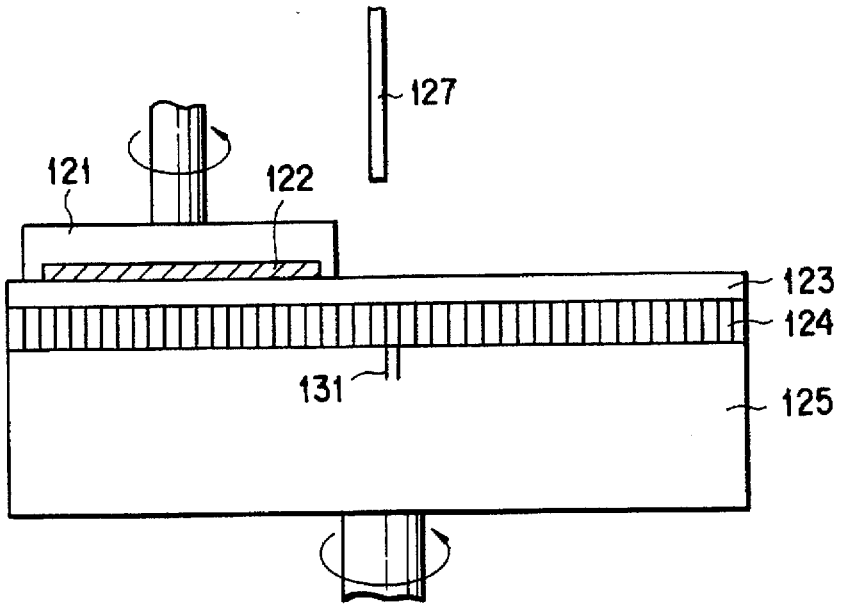
FIG. 5 is a cross sectional view schematically showing the construction of a polishing apparatus according to a second embodiment of the present invention.

FIG. 5 is a cross sectional view schematically showing the construction of a polishing apparatus according to a second embodiment of the present invention. As shown in the drawing, a substrate 122 to be processed is held by a rotatable sample holder 121 by means of a vacuum chuck such that the surface to be polished of the substrate 122 faces downward. Also, the polishing surface of the substrate is pushed against a polishing pad 123 fixed to a fluid cushion 124 positioned on a rotatable SUS base body 125.

Figure 6:
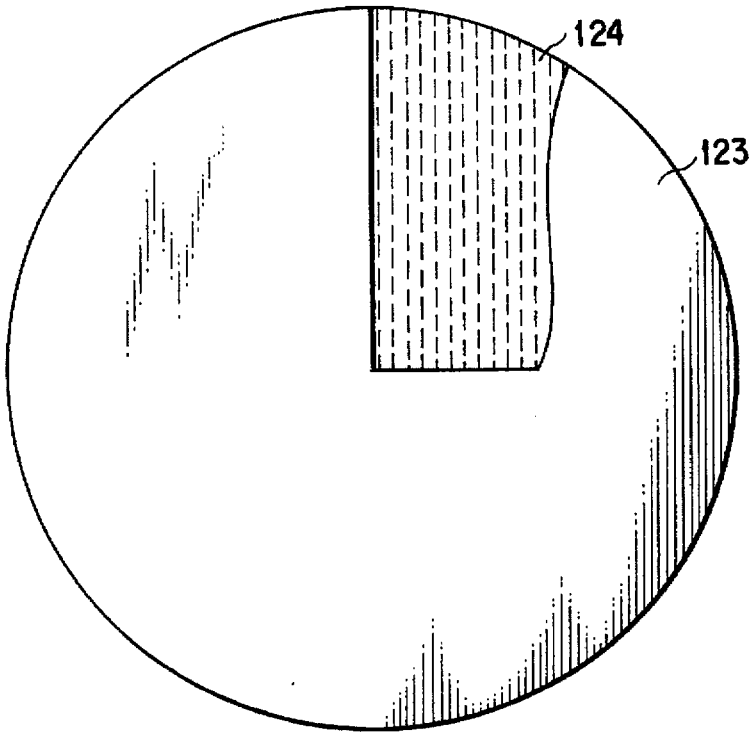
FIG. 6 is a top view showing an air-cell mat included in the polishing apparatus shown in FIG. 5.

The fluid cushion 124 consists of a large cloth bag woven by strings and reinforcing strings stuck to the cloth bag. The peripheral portion of the cloth bag is impregnated with rubber to ensure an air-tightness of the bag. The air is blown into the cloth bag through an air supply port 131 so as to enable the fluid cushion to perform its proper function. FIG. 6 shows the polishing pad 123 and the fluid cushion 124 as seen from above.

An 8-inch wafer covered with a silicon oxide film having a stepped portion was polished by the polishing apparatus described above so as to evaluate the uniformity of the polishing rate over the entire surface of the wafer. The pressure inside the fluid cushion 124 was set at 1.2 $kg/cm^2$ so as to fix the polishing pad 123 made of a foamed polyurethane and positioned on the surface of the fluid cushion 124. The polishing agent used was prepared by dispersing 1% by weight of cerium oxide in water. During the polishing operation, the sample was pushed against the polishing pad with a pressure of 0.3 $kg/cm^2$. Also, each of the sample holder 121 and the polishing base plate 125 was rotated at a speed of 100 rpm.

The nonuniformity of the polishing rate was ±10% in the case of using a polishing apparatus in which a polishing pad made of a foamed polyurethane was fixed to an ordinary base body, and ±25% in the case of using a polishing apparatus in which a foamed polyurethane polishing pad was fixed to a conventional fluid cushion not using reinforcing strings and having an air of 1.0 $kg/cm^2$ sealed therein. On the other hand, the nonuniformity in question was as low as ±4% in the case of using the polishing apparatus of the present invention constructed as shown in FIGS. 5 and 6.

The reason for the above-noted excellent uniformity of the polishing rate achieved by the polishing apparatus of the present invention is considered to be as follows. Specifically, when it comes to the conventional fluid cushion, the polishing pad was found to be markedly deformed when the inner pressure of the fluid cushion was increased to exceed the atmospheric pressure. To be more specific, the fluid cushion was found to be markedly deformed when the air was blown in advance into the fluid cushion to set up an inner pressure higher than the atmospheric pressure, and when the substrate to be treated was pressed against the polishing pad, leading to serious problems. First of all, the polishing head was found to be vibrated during the polishing operation. Further, the rotating speed of the polishing head or the polishing pad was found to fail to be stable. Because of these problems, the load distribution over the entire surface of the substrate was rendered nonuniform, leading to a low uniformity in the polishing rate over the entire surface of the substrate.

In the polishing apparatus of the present invention, however, a large number of reinforcing strings are stuck within the fluid cushion, with the result that the polishing pad was prevented from being deformed even when the inner pressure of the fluid cushion was increased to exceed the atmospheric pressure. In other words, it was possible to blow in advance the air into the fluid cushion to make the inner pressure of the fluid cushion higher than the atmospheric pressure. As a result, deformation of the fluid cushion was suppressed even when the substrate to be treated was pressed against the polishing pad, making it possible to prevent the polishing head from being vibrated during the polishing operation and to ensure a stable rotation of the polishing head or the polishing pad. Naturally, the load distribution over the working surface was rendered uniform, leading to an improved uniformity of the polishing rate over the entire surface of the substrate.

In the embodiment shown in FIGS. 5 and 6, the fluid cushion 124 was prepared by sticking reinforcing strings to a large cloth bag woven by strings. Alternatively, partitioning walls or the like can be used in place of the reinforcing strings so as to prevent the fluid cushion from being deformed, leading to the prominent effect of the present invention described above.

Also, in the embodiment described above, air was sealed in the fluid cushion. However, another gas such as a nitrogen gas or an oxygen gas can be sealed in the fluid cushion, with substantially the same effect. Further, a liquid such as water can be sealed in the fluid cushion, though a gaseous fluid such as air was found to be superior to a liquid fluid in respect of the uniformity of the polishing rate over the entire surface of the substrate. Still further, the most prominent uniformity in the polishing rate was obtained where the gaseous pressure within the fluid cushion was set higher than the atmospheric pressure, i.e., atmospheric pressure+working pressure.

In embodiment 2, the air is sealed inside the fluid cushion. However, a fluid pressure control means can be employed in place of sealing the air inside the fluid cushion, with substantially the same effect.

Embodiment 3

Figure 7:
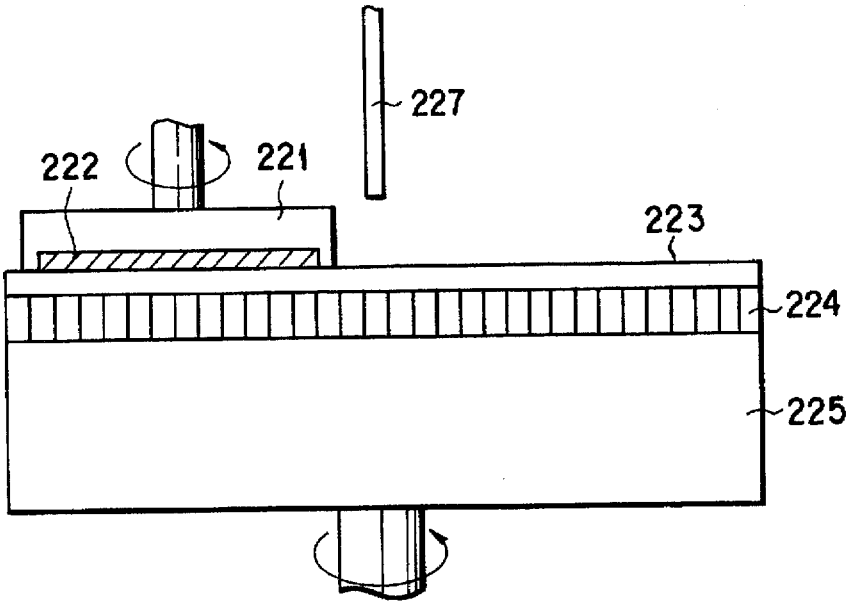
FIG. 7 is a cross sectional view schematically showing the construction of a polishing apparatus according to a third embodiment of the present invention.
Figure 8:
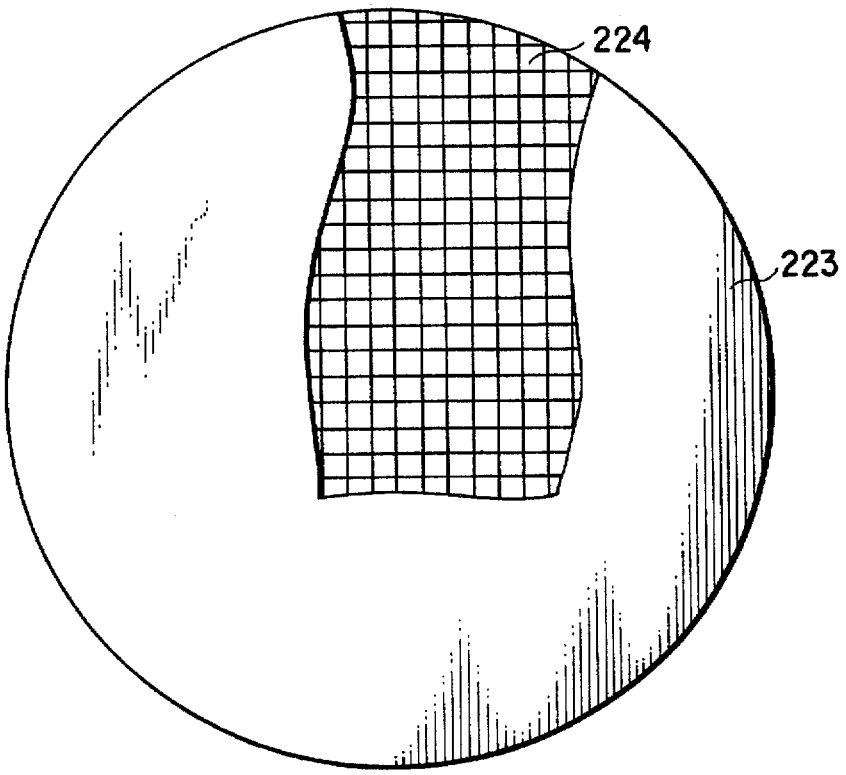
FIG. 8 is a top view showing an air-cell mat included in the polishing apparatus shown in FIG. 7.

FIG. 7 is a cross sectional view schematically showing the construction of a polishing apparatus according to a third embodiment of the present invention. As shown in the drawing, a substrate 222 to be processed is held by a rotatable sample holder 221 by means of a vacuum chuck such that the surface to be polished of the substrate 222 faces downward. Also, the polishing surface of the substrate is pushed against a polishing pad positioned on a rotatable SUS base body 225 and consisting of a foamed polyurethane sheet 223 having a thickness of 1.3 mm and an air-cell mat 224 positioned below the foamed polyurethane sheet 223. Naturally, a polishing agent is retained on the surface of the foamed polyurethane sheet 223. The mat 224 consists of a large number of independent polyethylene cells each having air of atmospheric pressure sealed therein. These cells are uniform in height, i.e., 10 mm, and have cross sectional areas falling within a range of between 10×10 (mm) and 55×55 (mm), and have volumes falling within a range of between 1 $cm^3$ and 30 $cm^3$. FIG. 8 shows the polishing pad of the particular construction, as seen from above.

Figure 9:
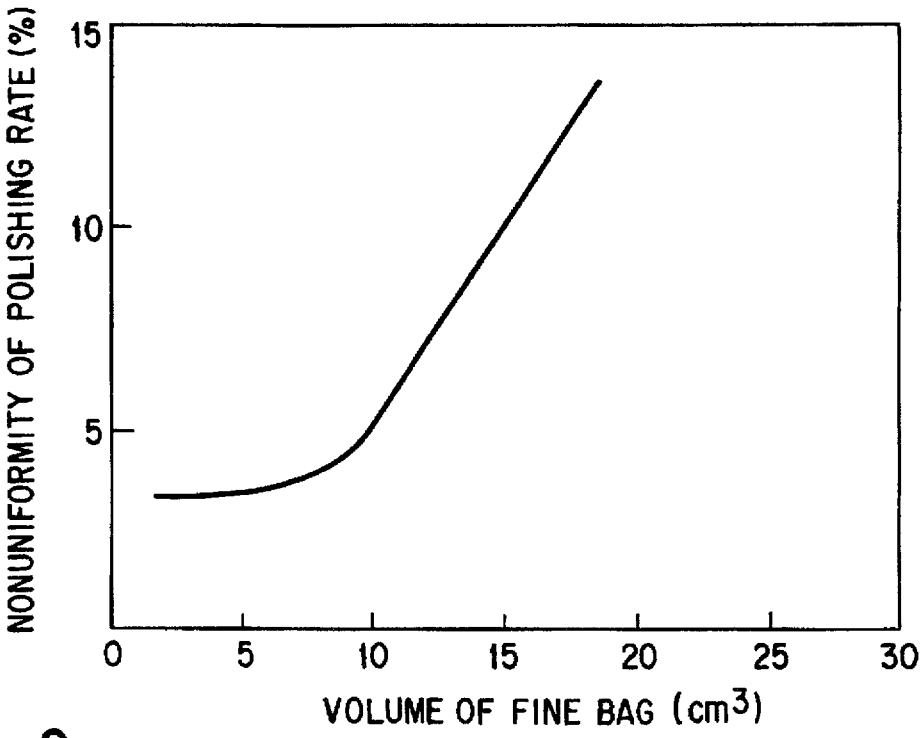
FIG. 9 is a graph showing the relationship between the volume of the air cells and the nonuniformity in the polishing rate in the polishing apparatus according to the third embodiment of the present invention.

An 8-inch silicon wafer covered with a silicon oxide film having a stepped portion was polished by using the polishing pad of the construction described above so as to evaluate the uniformity of the polishing rate over the entire surface of the wafer. A polishing agent used was prepared by dispersing 1% by weight of cerium oxide in water. FIG. 9 is a graph showing the result in respect of the relationship between the volume of the air cell formed in the polyethylene cell mat 224 and the nonuniformity of the polishing rate. As seen from the graph, the nonuniformity of the polishing rate was less than ±10% in the case of using a polishing pad consisting of a foamed polyurethane sheet and a mat consisting of air cells each having a volume of 15 $cm^3$, i e., 39×39×10 (mm). Incidentally, the nonuniformity of the polishing rate was ±10% in the case of using a polishing pad 223 consisting of a foamed polyurethane sheet alone, supporting that the polishing pad of the present invention including the air-cell mat 224 permits improving the uniformity of the polishing rate over the entire surface of the substrate. On the other hand, the nonuniformity of the polishing rate was as low as ±5% or less in the case of using a polishing pad consisting of a foamed polyurethane sheet and a mat consisting of air cells each having a volume of 10 $cm^3$, i.e., 32×32×10 (mm), supporting that the polishing apparatus of the present invention permits prominently improving the uniformity of the polishing rate over the entire surface of the substrate. Incidentally, the polishing pad was found to leave room for further improvement in durability in the case where the volume of the air cell is 0.1 $cm^3$ or less.

The experimental data shown in FIG. 9 clearly supports that it is desirable for the air cell formed in the mat 224 to have a volume falling within a range of between 0.1 $cm^3$ to 15 $cm^3$, preferably between 0.1 $cm^3$ and 10 $cm^3$. Where the air cell volume exceeds 15 $cm^3$, vibration of the polishing pad was found to be seriously prominent.

It is considered reasonable to understand that, where the air cell has a small cross sectional area, the polishing head can be prevented from being vibrated, leading to improvement in the uniformity of the polishing rate over the entire surface of the wafer. Alternatively, it is considered reasonable to understand that, where the air cell has a small cross sectional area, the sample holder or the polishing pad can be rotated with a high stability so as to improve the load distribution over the working surface of the substrate to be treated, leading to improvement in the uniformity of the polishing rate over the entire surface of the wafer.

Embodiment 4

Figure 10:
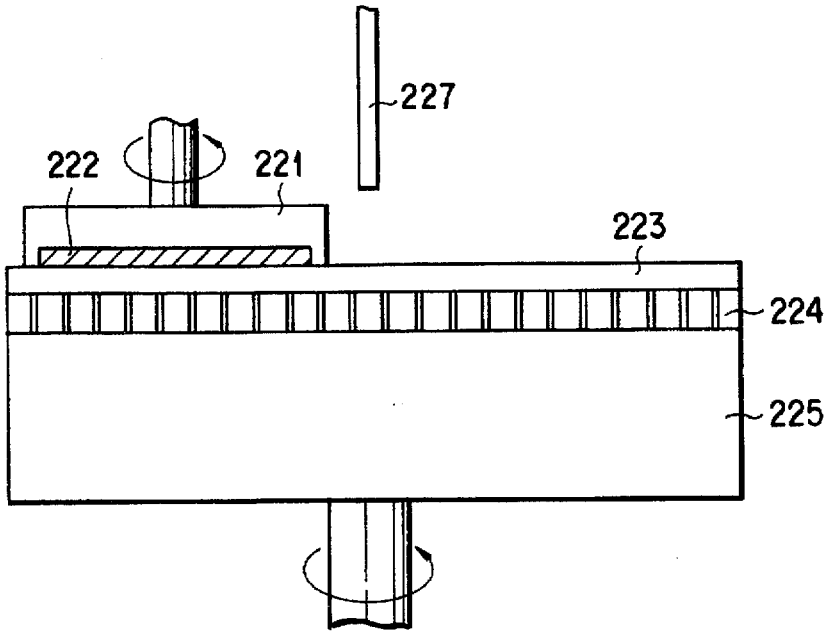
FIG. 10 is a cross sectional view schematically showing the construction of a polishing apparatus according to a fourth embodiment of the present invention.
Figure 11:
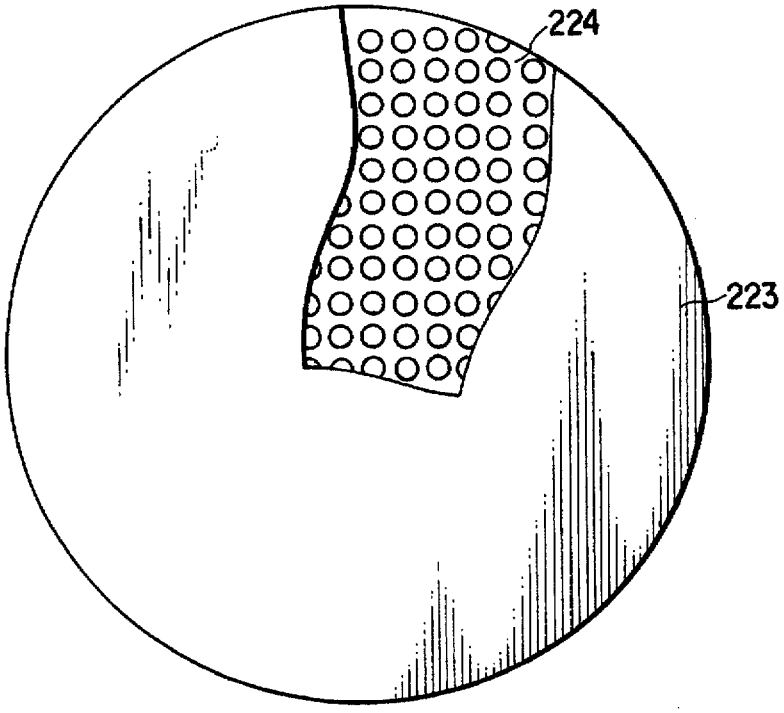
FIG. 11 is a top view showing an air-cell mat included in the polishing apparatus shown in FIG. 10.

FIG. 10 is a cross sectional view schematically showing the construction of a polishing apparatus according to a fourth embodiment of the present invention. As shown in the drawing, a substrate 222 to be processed is held by a rotatable sample holder 221 by means of a vacuum chuck such that the surface to be polished of the substrate 222 faces downward. Also, the polishing surface of the substrate is pushed against a polishing pad positioned on a rotatable SUS base body 225 and consisting of a foamed polyurethane sheet 223 having a thickness of 1.3 mm and an air-cell mat 224 positioned below the foamed polyurethane sheet 223. Naturally, a polishing agent is retained on the surface of the foamed polyurethane sheet 223. The mat 224 consists of a large number of independent columnar polyethylene cells each having air of atmospheric pressure sealed therein. Each of these cells has a diameter of 31 mm, a height of 13 mm and, thus, a volume of 9.8 $cm^3$. It should be noted that these cells are arranged at a cell ratio of 72%. FIG. 11 shows the polishing pad of the particular construction, as seen from above.

An 8-inch silicon wafer covered with a silicon oxide film having a stepped portion was polished by using the polishing pad of the construction described above so as to evaluate the uniformity of the polishing rate over the entire surface of the wafer. A polishing agent used was prepared by dispersing 1% by weight of cerium oxide in water. The nonuniformity of the polishing rate was found to be as low as ±3% in the case of using a polishing pad of the construction shown in FIGS. 10 and 11 in contrast to ±10% in the case of using a polishing pad consisting of a foamed polyurethane sheet alone.

It should be noted that the polishing pad in the fourth embodiment of the present invention has been found superior to the polishing pad in the third embodiment in respect of the uniformity of the polishing rate. The reason for the prominent effect produced by the fourth embodiment, which has not yet been clarified sufficiently, is considered to be as follows. Specifically, in the fourth embodiment, the adjacent cells are positioned apart from each other, with the result that the deformation or vibration occurring in one of the air-cells of the polishing pad is unlikely to be transmitted to adjacent cells. This is considered to enable the fourth embodiment to produce the effect of preventing the vibration of the polishing pad more effectively than the third embodiment. Alternatively, the particular construction in the fourth embodiment is considered to permit ensuring a stable rotation of the sample holder or the polishing pad more effectively than in the third embodiment, leading to the prominent effect produced by the fourth embodiment.

Figure 12:
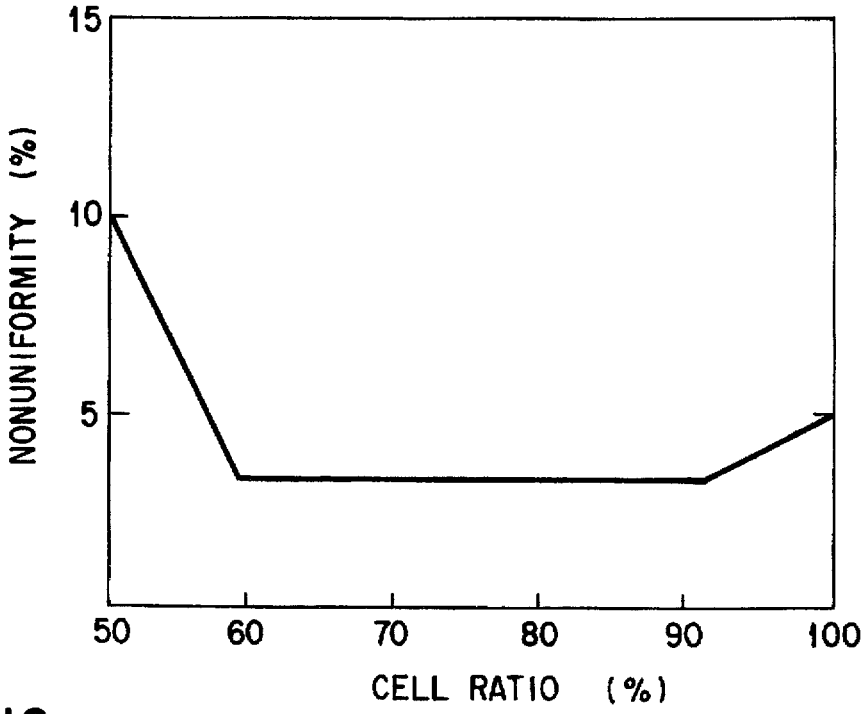
FIG. 12 is a graph showing the relationship between a cell ratio, i.e., percentage of air-cell area based on the entire surface of the polishing pad, and the nonuniformity of the polishing rate.

An additional experiment was conducted in order to look into the relationship between the cell ratio, i.e., percentage of air-cell area based on the entire surface of the polishing pad, and the nonuniformity of the polishing rate. The air-cell was columnar and sized at 31 mm in diameter, 13 mm in height, and 9.8 $cm^3$ in volume. The experiment was conducted by using various polishing pads having an air-cell ratio falling within a range of between 50% and 100%. FIG. 12 is a graph showing the results of the experiment. As apparent from FIG. 12, the nonuniformity of the polishing rate was found to be less than 10%. The nonuniformity, which was about 10% at the cell ratio of 50%, was gradually lowered with an increase in the cell ratio, reaching the lowest nonuniformity (or highest uniformity) at the cell ratio of 60%. The lowest nonuniformity was maintained until the cell ratio was increased to reach 90%. Where the cell ratio was lower than 50%, the load distribution was rendered nonuniform, leading to a marked deterioration in the uniformity of the polishing rate over the entire surface of the substrate. It follows that the cell ratio should be at least 50%, preferably 60 to 90%.

Incidentally, the optimum cell ratio was found to be dependent on the shape of the air-cell, the bending rigidity of the material as an upper layer of the polishing pad, and the load applied to the working surface. It is considered reasonable to understand that the reason for the change in the optimum cell ratio depending on the shape of the cell, the bending rigidity, and the load noted above resides in that the cell shape, etc. cause changes in the pad deformation and in the transmitting manner of the vibration to the adjacent cell. It is also considered reasonable to understand that the load distribution over the working surface is changed by the cell ratio, bending strength, etc., leading to the above-noted manner of change in the optimum cell ratio.

Figure 13:
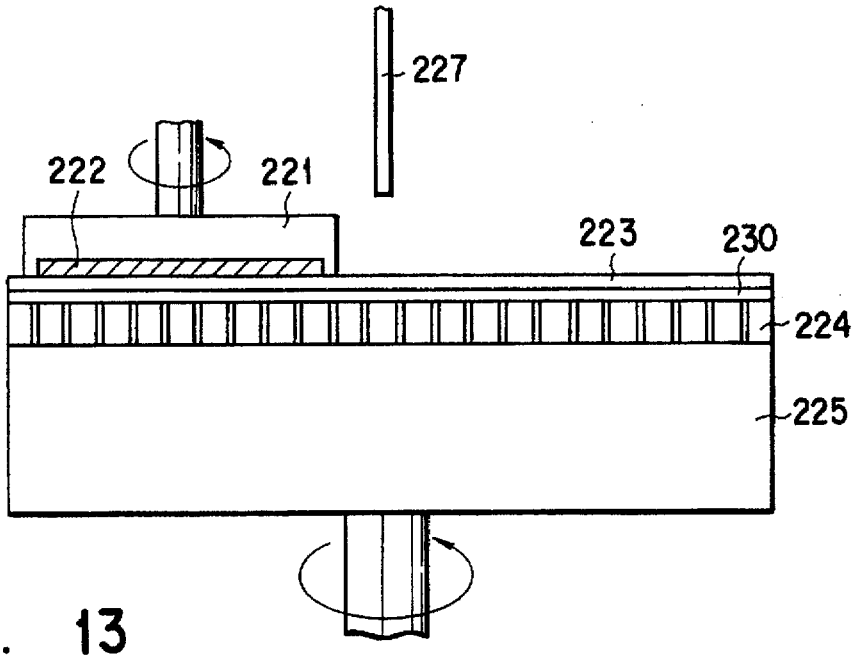
FIG. 13 is a cross sectional view schematically showing the construction of a polishing apparatus according to a modification of the fourth embodiment of the present invention.

An additional experiment was conducted by interposing a reinforcing layer, e.g., a thin stainless steel plate 230, between the foamed polyurethane sheet 223 and the mat 224, as shown in FIG. 13, with substantially the same result.

Then, a mirror polishing was applied to the 8-inch silicon wafer by using a polishing pad in which an unwoven fabric 1 mm thick was substituted for the foamed polyurethane sheet 223 so as to evaluate the flatness TTV (Total Thickness Variation) of the wafer surface. A colloidal silica powder slurry having a pH value of 11 was used as a polishing agent. The flatness TTV was found to be 3 μm or less in the case of using the polishing pad of a single layer structure consisting of the unwoven fabric alone in contrast to only 1 μm or less in the case of using the polishing pad according to the fourth embodiment of the present invention.

Figure 14A:
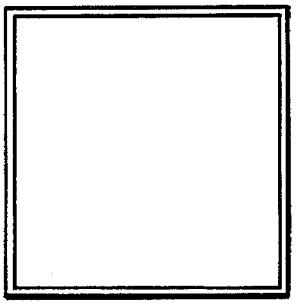
FIGS. 14A to 14C collectively show in detail the construction of a mat used in a polishing apparatus according to a fourth embodiment of the present invention.
Figure 14B:
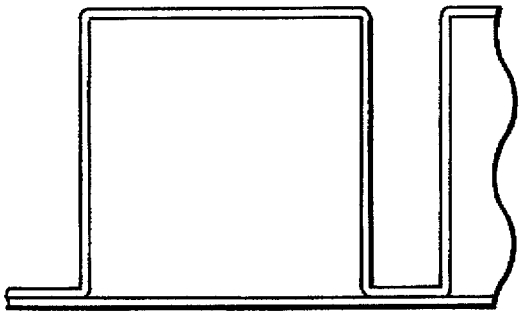
Figure 14C:
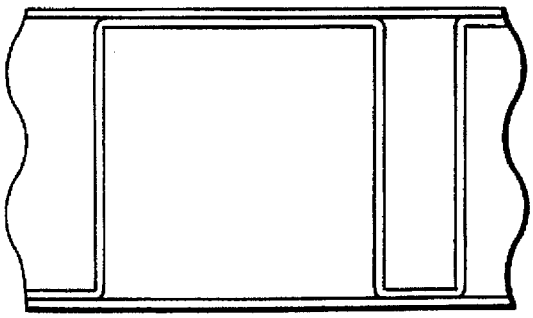

FIGS. 14A to 14C show the constructions of the air-cells used in the polishing apparatus according to the fourth embodiment of the present invention. Specifically, FIG. 14A shows an integral polyethylene air-cell having air of atmospheric pressure sealed therein. FIG. 14B shows the air-cell prepared by pressure-bonding two polyethylene sheets superposed one upon the other. Further, FIG. 14C shows the air-cell prepared by pressure-bonding three polyethylene sheets superposed one upon the other. The air-cell shown in either of FIGS. 14B and 14C has been found to be superior in durability to the air-cell shown in FIG. 14A. It has also been found that the durability of the air-cell can be improved by adding vinyl acetate to the polyethylene. Further, the durability has been found to be more satisfactory in the case where the upper and lower surfaces are substantially flat under the non-pressed condition as in the fourth embodiment than in other cases.

In the fourth embodiment described above, a foamed polyurethane sheet or unwoven fabric was used as an upper layer of the polishing pad which is brought into direct contact with the substrate to be polished. However, it is also possible to use a polyvinyl chloride sheet or polyethylene sheet in place of the foamed polyurethane sheet or unwoven fabric, with substantially the same effect. Further, a dimple processing can be applied to the sheet forming the upper layer of the polishing pad, with substantially the same effect. Still further, it is possible to impart a polishing agent-retaining function to the air-cell portion so as to obtain effects similar to those described above.

Embodiment 5

Figure 15:
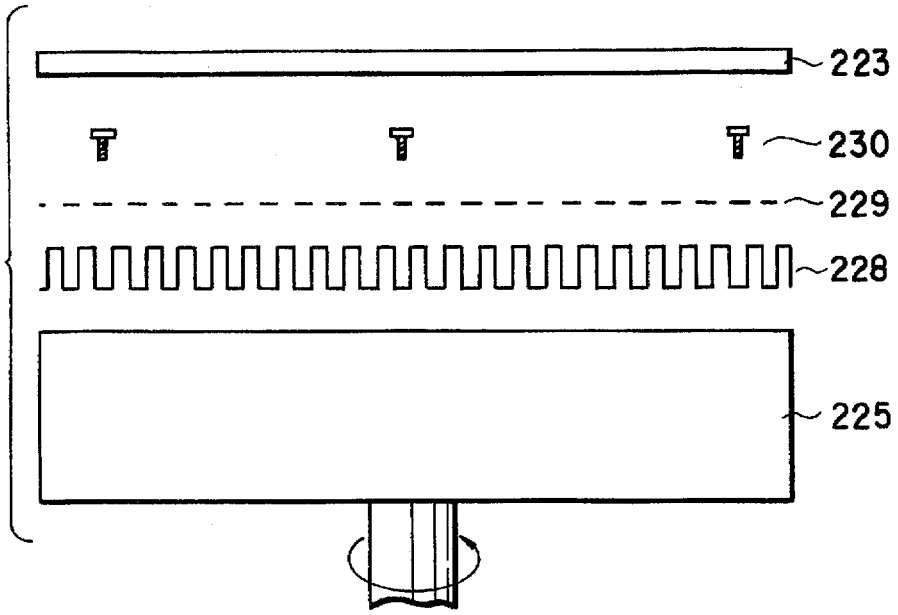
FIG. 15 is a cross sectional view schematically showing the construction of a polishing apparatus according to the fifth embodiment of the present invention.
Figure 16:
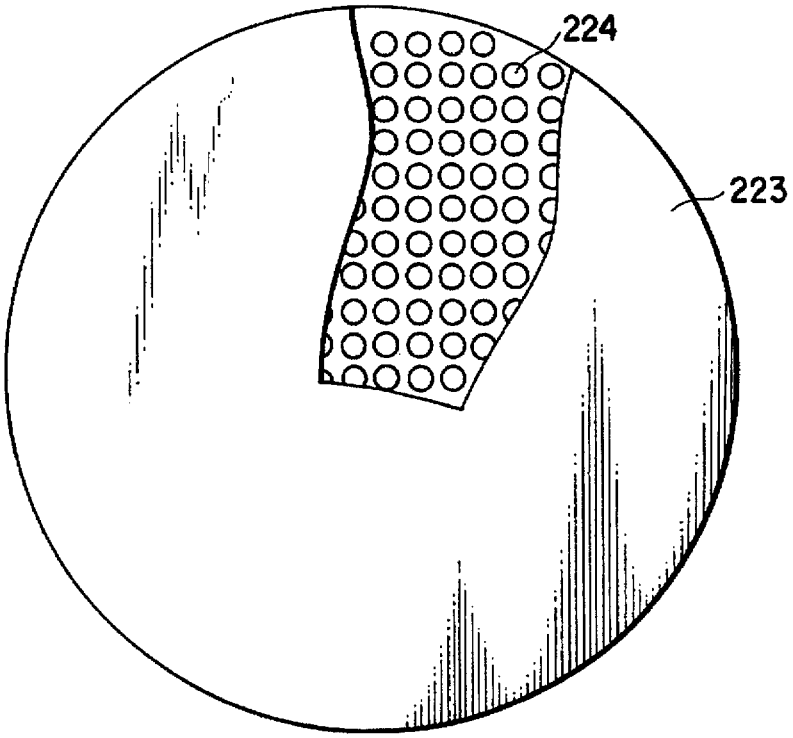
FIG. 16 is a top view showing an air-cell mat included in the polishing apparatus shown in FIG. 15.

FIG. 15 is a cross sectional view schematically showing the construction of a polishing apparatus according to a fifth embodiment of the present invention. As shown in the drawing, the polishing apparatus comprises a polishing base body prepared by fixing an unwoven fabric 228 having an alternately patterned surface of a projection-recess configuration and impregnated with rubber to a rotatable SUS plate 225. The unwoven fabric 228 of the particular construction is fixed by screws 230 to the SUS plate 225 so as to form air-cells having air of pressure higher than the atmospheric pressure sealed therein. Further, a polishing pad 223 serving to retain a polishing agent is fixed to the polishing base body. During the polishing operation, the polishing pad is pressed against the substrate to be polished while supplying a polishing agent to the upper surface of the polishing pad 223. FIG. 16 shows the polishing pad 223 and the polishing base plate 225 as seen from above.

In this embodiment, columnar air-cells each sized at 31 mm in diameter and 13 mm in height (or volume of 9.8 $cm^3$) were formed on the polishing base body at a cell ratio of 70%. Also, a polyurethane sheet 223 having a thickness of 1.3 mm was used as a polishing pad.

A sample of an 8-inch silicon wafer covered with a silicon oxide film having a stepped portion was polished by using the polishing apparatus described above so as to evaluate the uniformity of the polishing rate over the entire surface of the sample. The polishing agent used was prepared by dispersing 1% by weight of cerium oxide in water. The nonuniformity of the polishing rate was found to be as low as ±3% or less in the case of using the polishing pad in this embodiment in contrast to ±10% in the case where the polishing pad in this embodiment was not used.

Figure 17:
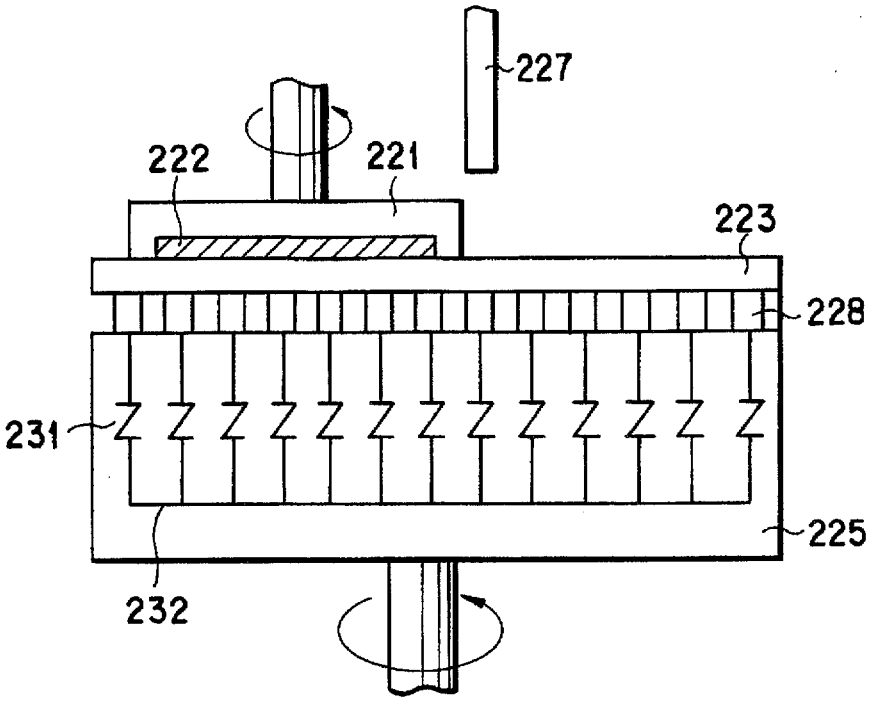
FIG. 17 is a cross sectional view schematically showing the construction of a polishing apparatus according to a modification of the fifth embodiment of the present invention.

FIG. 17 shows a modification of the polishing apparatus shown in FIGS. 15 and 16. In this modification, a fluid supply means 232 is connected to the air-cell. Further, an ordinary valve or check valve 231 is mounted to the fluid supply means 232 to hermetically seal the air-cell, as shown in the drawing. This modification was found to produce an excellent effect similar to that produced by the apparatus shown in FIGS. 15 and 16.

Embodiment 6

Figure 18:
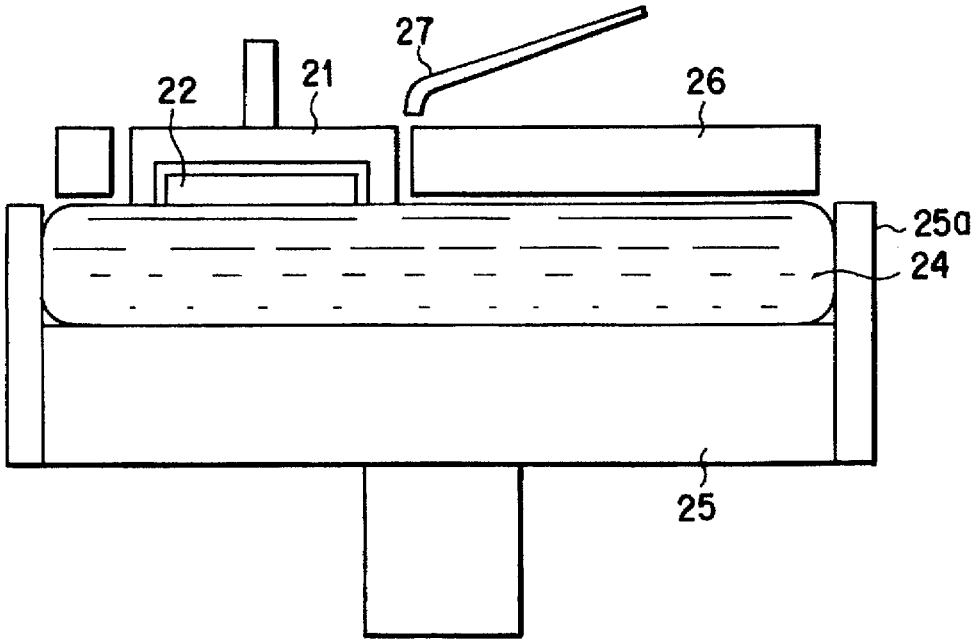
FIG. 18 is a cross sectional view schematically showing the construction of a polishing apparatus according to a sixth embodiment of the present invention.

FIG. 18 is a cross sectional view schematically showing the construction of a polishing apparatus according to a sixth embodiment of the present invention. As shown in the drawing, a substrate 22 to be processed is held by a rotatable sample holder 21 by means of a vacuum chuck such that the surface to be polished of the substrate 22 faces downward. Also, the polishing surface of the substrate is pushed against a polishing pad 23 fixed to a fluid cushion 24 positioned on a rotatable SUS base body 25. The fluid cushion 24 consists of a soft polyvinyl chloride resin bag loaded with water.

The side surface of the SUS base body 25 is surrounded by a supporting frame 25*a* projecting upward of the upper surface of the SUS base body 25. As a result, a recess positioned above the upper surface of the SUS base body 25 is defined by the supporting frame 25*a*. The recess is deep enough to permit the cushion 24 having a polishing pad mounted thereon to be positioned therein. Alternatively, it is possible to increase the height of the supporting frame 25*a* so as to store therein the polishing agent in the polishing step such that the polishing pad is dipped in the stored polishing agent. Further, it is possible for the SUS base body 25 to make a circular motion or an eccentric small circular motion.

In order to uniformly pressurize the entire surface of the polishing pad for preventing the cushion 24 from being appreciably deformed, a dummy pressurizing mechanism 26 is arranged around the sample holder 21 in a manner not to inhibit the motion of the sample holder 21. A polishing agent supply pipe 27 extends obliquely downward from a polishing agent tank (not shown) to a region above the upper surface of the SUS base body 25, making it possible to control the supply amount of the polishing agent. The polishing pad used in this embodiment was prepared by regularly arranging foamed polyurethane pieces each sized at 1 cm×1 cm×1.3 mm at an interval of 1.1 mm such that a groove 1 mm wide was defined to form a lattice.

Figure 19A:
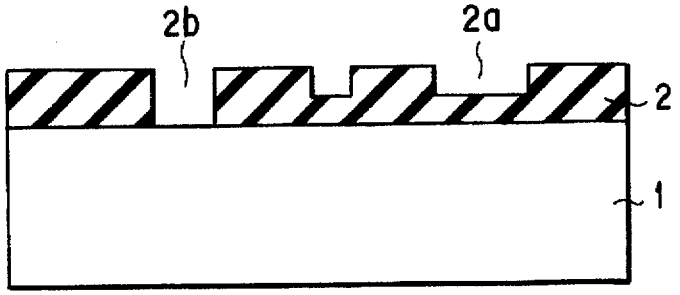
FIGS. 19A to 19C are cross sectional views collectively showing how a polishing apparatus of the present invention is used in the manufacture of a semiconductor device.
Figure 19B:
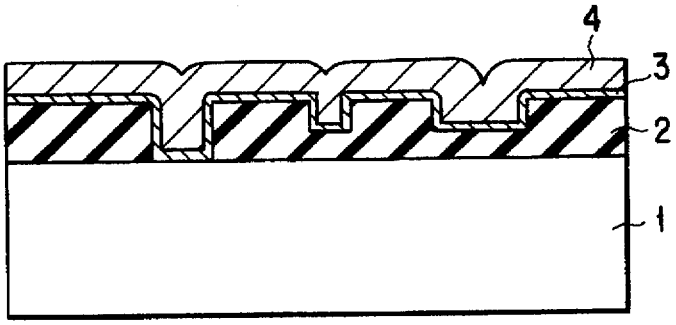
Figure 19C:
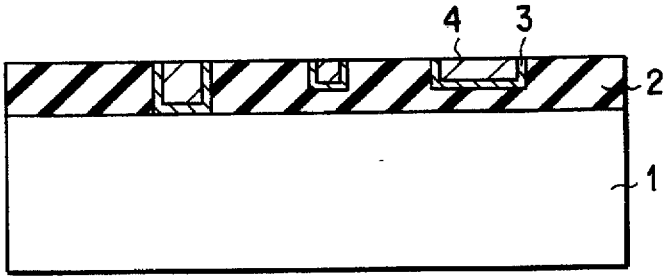

FIGS. 19A to 19C are cross sectional views collectively showing how a surface having stepped portions of a sample was polished by the polishing apparatus of the present invention. In the first step, a silicon oxide film 2 was formed in a thickness of about 1 μm on a silicon substrate 1, as shown in FIG. 19A. Then, a groove 2*a* for forming a wiring layer was formed in a surface region of the silicon oxide film 2 in a width of 0.4 to 10 μm and a depth of 0.4 μm. Also formed was a contact hole 2*b* through the silicon oxide film 2 to expose the upper surface of the silicon substrate 1. This groove 2*a* and contact hole 2*b* were formed by the ordinary lithographic process and reactive ion etching process. In the next step, a TiN film 3 was formed in a thickness of about 50 nm by a DC magnetron sputtering method, followed by forming a copper film 4 in a thickness of about 600 nm by the DC magnetron sputtering method, as shown in FIG. 19B. After formation of the TiN film 3 and Cu film 4, these films 3 and 4 were selectively removed by the chemical-mechanical polishing (CMP) method using the apparatus shown in FIG. 18 such that these TiN and Cu films 3 and 4 were left unremoved only within the groove 2*a* and the contact hole 2*b*, as shown in FIG. 19C.

The polishing agent used for the CMP method was prepared by dispersing 5% by weight of silica particles in a mixed solution consisting of an aqueous solution containing 0.12 mol % of glycine and 0.44 mol % of hydrogen peroxide, followed by further dispersing 0.001 mol % of benzotriazole (BTA) as an inhibitor to the resultant silica dispersion.

A sample as shown in FIG. 19B was subjected to a CMP process using the apparatus shown in FIG. 18. During the polishing process, the SUS base body 25 and the polishing agent stored in the recess above the SUS base body 25 were kept constant at 25° C. The polishing pressure was set at 300 gf/cm$^2$. Each of the SUS base body 25 and the sample holder 21 was rotated at a speed of 60 rpm. Further, the temperature within the experimental room was 25° C.

An average polishing rate of the Cu film was found to be about 120 nm/min. On the other hand, an average polishing rate of the TiN film was about 30 nm/min. The nonuniformity of the polishing rate over the entire surface of the wafer sample was found to be ±4% in contrast to such a large value as ±15% in the case of using a conventional polishing apparatus. Incidentally, the nonuniformity of the polishing rate was determined by: (Max−Min)/(Max+Min)×100, where "Max" denotes the maximum polishing rate, with "Min" denoting the minimum polishing rate.

Figure 20A:
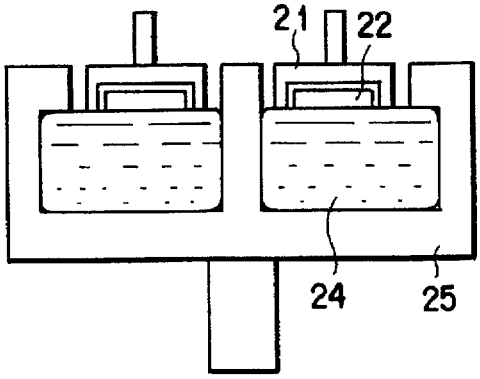
FIG. 20A is a cross sectional view schematically showing the construction of a polishing apparatus according to a modification of the sixth embodiment of the present invention.
Figure 20B:
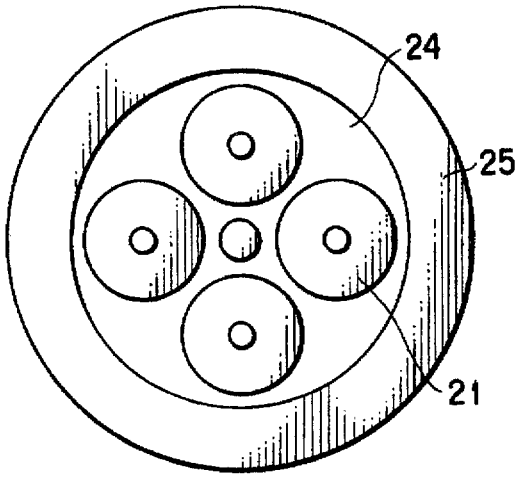
FIG. 20B is a plan view schematically showing the construction of the polishing apparatus shown in FIG. 20A.

FIGS. 20A and 20B are a cross sectional view and a plan view, respectively, collectively showing a modification of the polishing apparatus according to the sixth embodiment (FIG. 18) of the present invention. In this modification, a plurality of sample holders 21 are arranged in contact with the cushion 24. Naturally, the modified apparatus permits polishing a plurality of substrates 22 simultaneously.

The present invention is not limited to the embodiments described above. Specifically, a silicon oxide film, a TiN film and a Cu film were subjected to the CMP process in the embodiments described above. However, the polishing technology of the present invention can also be applied satisfactorily to films of various other materials such as Al, polycrystalline silicon, W and Ru. Of course, the polishing rate and uniformity of the polishing rate over the entire surface of the substrate to be polished are dependent on, for example, the polishing agent-holding capability of the polishing pad on the surface in direct contact with the substrate and on the kind of the polishing agent used.

In Embodiments 3 to 5 described herein, air of the atmospheric pressure was sealed in the air-cells. However, other gases or liquid materials can be sealed in the cells, with satisfactory effect, though a gaseous fluid such as air was found to be superior to a liquid fluid in respect of the uniformity of the polishing rate over the entire surface of the substrate. Still further, a good uniformity in the polishing rate was obtained where the gaseous pressure within the fluid cushion was set slightly higher than the atmospheric pressure.

Figure 21:
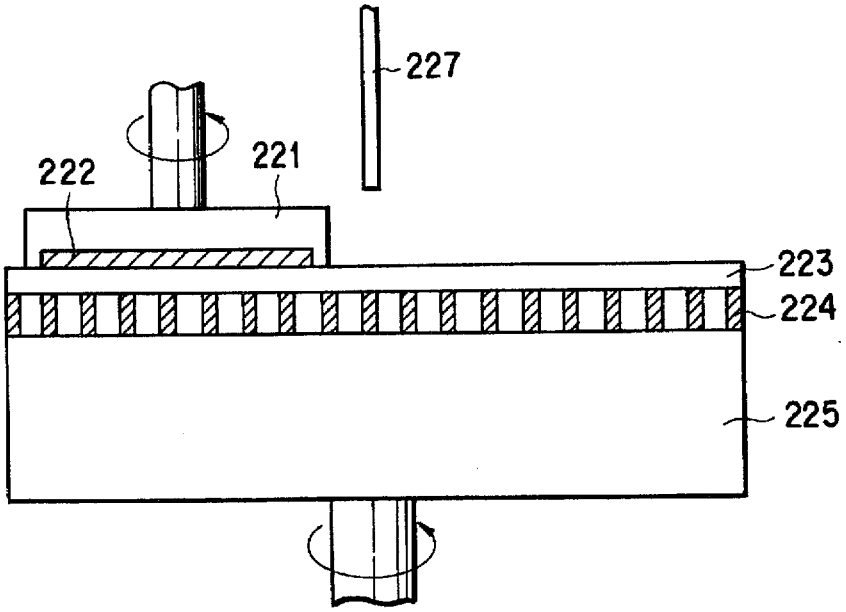
FIG. 21 is a cross sectional view schematically showing the construction of a polishing apparatus according to still another embodiment of the present invention.
Figure 22:
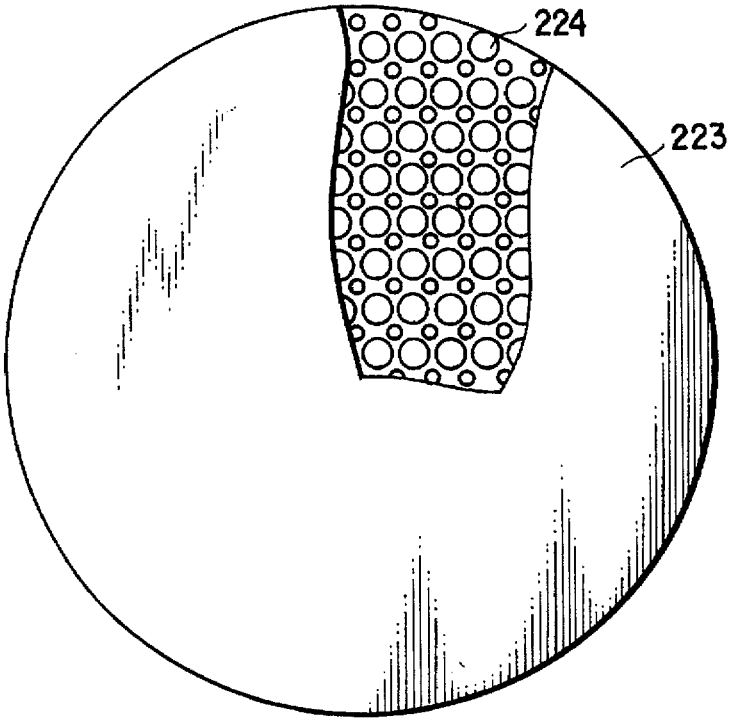
FIG. 22 is a top view showing the air-cell mat included in the polishing apparatus shown in FIG. 21.

Further, in Embodiments 3 to 5, air-cells of the same shape were disposed below the polishing pad. However, it is also possible to use in combination air-cells of a large diameter and a small diameter, as shown in FIGS. 21 and 22.

Still further, a polyethylene sheet or a unwoven fabric impregnated with rubber were used for forming the air-cells in the embodiments described herein. However, it is also possible to use other materials for forming the air-cells as far as the expansion of the resultant cell upon receipt of a predetermined load is not larger than 10%.

Of course, various other modifications are available within the technical scope of the present invention.

As described above in detail, a polishing pad is supported by a fluid-retaining section in the polishing apparatus of the present invention, making it possible to achieve a uniform pressure distribution over the entire surface of the substrate to be polished such as a semiconductor wafer, leading to a marked improvement in the uniformity of the polishing rate over the entire surface of the substrate surface. It follows that the present invention permits improving the yield in the manufacture of semiconductor elements and the reliability of the manufactured semiconductor device.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A polishing pad, comprising at least:

a first layer having a first main surface serving to polish a substrate and a second main surface; and a second layer arranged on said second main surface of the first layer and having fine bags therein, said fine bags being positionally fixed relative to each other and isolated from each other, said fine bags hermetically containing fluid.

2. The polishing pad according to claim 1, wherein said fluid is gaseous.

3. The polishing pad according to claim 1, wherein each of said fine bags has a substantially flat upper surface and a substantially flat lower surface.

4. The polishing pad according to claim 1, wherein a percentage of fine bag area based on the entire surface of the polishing pad is at least 50%.

5. The polishing pad according to claim 4, wherein a percentage of fine bag area based on the entire surface of the polishing pad falls within a range of 60% and 90%.

6. The polishing pad according to claim 1, wherein said fine bags are regularly arranged.

7. The polishing pad according to claim 1, wherein each of said fine bags has a volume falling within a range of between 0.1 $cm^3$ and 15 $cm^3$.

8. The polishing pad according to claim 7, wherein each of said fine bags has a volume falling within a range of between 0.1 $cm^3$ and 10 $cm^3$.

9. The polishing pad according to claim 1, wherein a reinforcing layer is interposed between said first and second layers.

10. A polishing apparatus, comprising:

means for holding or pressing a substrate to be polished;

a base body having fine bags fixed thereto, said fine bags being isolated from each other; and a polishing pad interposed between said means for holding or pressing said substrate and said base body.

11. The polishing apparatus according to claim 10, wherein said base body is a rotatable plate.

12. The polishing apparatus according to claim 10, wherein fluid is hermetically sealed in said fine bags.

13. The polishing apparatus according to claim 12, wherein said fluid is gaseous.

14. The polishing apparatus according to claim 10, wherein said base body is provided with means for hermetically sealing said fluid within the fine bags.

15. The polishing apparatus according to claim 14, wherein said fluid is gaseous.

16. The polishing apparatus according to claim 10, wherein each of said fine bags has a substantially flat upper surface and a substantially flat lower surface.

17. The polishing apparatus according to claim 10, wherein a percentage of fine bag area based on the entire surface of the polishing pad is at least 50%.

18. The polishing apparatus according to claim 17, wherein a percentage of fine bag area based on the entire surface of the polishing pad falls within a range of 60% and 90%.

19. The polishing apparatus according to claim 10, wherein said fine bags are regularly arranged.

20. A polishing method, comprising the steps of:

allowing a substrate to be held on a substrate holding section;

supplying a polishing agent onto a polishing surface positioned on fine bags fixed to a base body, said fine bags being isolated from each other; and rotating said base body to permit said substrate holding section to be pressed against the base body so as to polish a surface of the substrate to be polished.

21. The polishing method according to claim 20, wherein said base body is a rotatable plate.

22. A polishing pad comprising at least:

a first layer having a first main surface serving to polish a substrate to be polished and a second main surface; and a second layer positioned to face said second surface of the first layer and having a fluid-retaining section filled with fluid, a number of reinforcing strings being arranged within said fluid-retaining section.

23. The polishing pad according to claim 22, wherein said fluid is gaseous.

24. The polishing pad according to claim 22, wherein a gas of a pressure higher than the atmospheric pressure is hermetically sealed in said fluid-retaining section.

25. A polishing apparatus, comprising:

means for holding or pressing a substrate to be polished;

base body having a fluid-retaining section arranged on an upper surface thereof, a number of reinforcing strings being arranged within said fluid-retaining section; and a polishing pad interposed between said means for holding or pressing the substrate and said base body.

26. The polishing apparatus according to claim 25, wherein said base body is a rotatable plate.

27. A polishing method, comprising the steps of:

allowing a substrate to be held on a substrate holding section;

supplying a polishing agent onto a polishing surface positioned on a fluid-supporting section formed on a base body, a number of reinforcing strings being arranged within said fluid-supporting section; and rotating said base body to permit said substrate-holding section to be pressed against the base body so as to polish a surface of the substrate.

28. The polishing method according to claim 27, wherein said base body is a rotatable plate.

29. A polishing apparatus, comprising:

means for holding or pressing a substrate to be polished;

a base body;

a fluid cushion including a polishing pad interposed between said means for holding or pressing the substrate and said base body, said base body having a supporting frame for supporting said fluid cushion arranged to extend upward from the side surfaces of the base body; and a dummy pressurizing mechanism for preventing said fluid cushion from being damaged.

30. The polishing apparatus according to claim 29, wherein said base body is a rotatable plate.

* * * * *